US008480439B1

(12) United States Patent
Chen et al.

(10) Patent No.: US 8,480,439 B1
(45) Date of Patent: Jul. 9, 2013

(54) KEYSTONE JACK

(75) Inventors: Chun-Chieh Chen, Taoyuan (TW); Shun-Fa Hung, Taoyuan (TW)

(73) Assignee: YFC-Boneagle Electric Co., Ltd., Taoyuang (TW)

( * ) Notice: Subject to any disclaimer, the term of this patent is extended or adjusted under 35 U.S.C. 154(b) by 41 days.

(21) Appl. No.: 13/332,295

(22) Filed: Dec. 20, 2011

(51) Int. Cl.
*H01R 24/00* (2011.01)

(52) U.S. Cl.
USPC ..... 439/676; 439/620.11

(58) Field of Classification Search
USPC ..... 439/76.1, 344, 620.11, 620.21, 676, 439/941
See application file for complete search history.

(56) References Cited

U.S. PATENT DOCUMENTS 5,403,200 A * 4/1995 Chen ..... 439/404
5,989,069 A * 11/1999 Tan ..... 439/620.23
6,157,542 A * 12/2000 Wu ..... 361/752
6,350,158 B1 * 2/2002 Arnett et al. ..... 439/676
6,457,993 B1 * 10/2002 Espenshade ..... 439/490
6,719,588 B1 * 4/2004 Zheng et al. ..... 439/620.04
6,974,352 B2 * 12/2005 Clark et al. ..... 439/676
7,744,429 B2 * 6/2010 Zhang et al. ..... 439/676

* cited by examiner

*Primary Examiner* — Thanh Tam Le
(74) *Attorney, Agent, or Firm* — Chun-Ming Shih; HDLS IPR Services

(57) ABSTRACT

A keystone jack includes a main body, a printed circuit board, a terminal base, and a plurality of terminals. Both sides of the main body have two first troughs and two second troughs. The printed circuit board is inserted into the main body and has two first hooks engaged with the two first troughs on its both sides. The terminal base is disposed on the printed circuit board and assembled with the main body. Both sides of the terminal base are formed with two second hooks engaged with the two second troughs. Both ends of each terminal are fixedly inserted into the printed circuit board and the terminal base respectively. By these two engaging means, the engagement strength of the components of the keystone jack is increased to thereby prevent the keystone jack from suffering damage.

11 Claims, 7 Drawing Sheets

KEYSTONE JACK

BACKGROUND OF THE INVENTION

1. Field of the Invention

The present invention relates to a keystone jack, and in particular to a keystone jack having double engaging means.

2. Description of Prior Art

With the advancement of science and technology, a keystone jack is often provided in an input/output panel of a computer host. The keystone jack is electrically connected to an Network card which is inserted onto a mother board of the computer host. When a user inserts a plug (e.g., a plug of R-45 standard) provided on an end of an Network cable into the keystone jack and accesses the Internet via a modem, the user can freely browse, download and send data or e-mail to another remote user via the Internet.

The conventional keystone jack includes: a main body, a printed circuit board, a terminal base, and a dustproof cover. The printed circuit board is inserted into the main body. The terminal base is assembled with the main body via one engaging means including a hook and a trough. The dustproof cover covers the terminal base. In practice use, since only one engaging means is provided between the terminal base and the main body, the strength of engagement is insufficient, and the stress concentration may often occur at a position near the place in which the engaging means is provided. As a result, the terminal base may break or suffer damage easily.

Therefore, it is an important issue for the present Inventor to solve the above-mentioned problems.

SUMMARY OF THE INVENTION

The present invention is to provide a keystone jack, which has double engaging means to thereby increase the strength of engagement of the components of the keystone jack and preventing the keystone jack from suffering damage.

The present invention provides a keystone jack, including:

a main body having two first troughs and two second troughs on its both side;

a printed circuit board inserted into the main body, both sides of the printed circuit board being formed with two first hooks engaged with the two first troughs;

a terminal base disposed on the printed circuit board and assembled with the main body, both sides of the terminal base being formed with two second hooks engaged with the two second troughs; and a plurality of terminals, both ends of each terminal being fixedly inserted into the printed circuit board and terminal base respectively.

In comparison with prior art, the present invention has the following advantageous features:

According to the keystone jack of the present invention, both sides of the main body are provided with two first troughs and two second troughs, both sides of the printed circuit board are formed with two first hooks engaged with the two first troughs, and both sides of the terminal base are formed with two second hooks engaged with the two second troughs. Therefore, the present invention has double engaging means. More specifically, the first engaging means is configured to fixedly connect the main body and the printed circuit board, and the second engaging means is configured to fixedly connect the main body and the terminal base. Finally, the terminals pierce the printed circuit board and the terminal base. In this way, the main body, the printed circuit board, and the terminal base can be firmly engaged with each other. Therefore, the present invention employs double engaging means to generate a greater strength of engagement of the components of the keystone jack. In this way, the problem of stress concentration is avoided, and the keystone jack can be prevented from breaking or suffering damage.

Further, the engaging means between the main body and the printed circuit board is provided on both sides of the main body and the printed circuit board, and the other engaging means between the main body and the terminal base is provided on both sides of the main body and the terminal base. Both engaging means (the first troughs and the first hooks, the second troughs and the second hooks) are provided on the same two sides of the main body and in parallel to an inserting direction of the printed circuit board into the main board and in parallel to an inserting direction of an external Network cable into the keystone jack. Therefore, the keystone jack of the present invention has a greater strength for sustaining the insertion and removal of the external Network cable for a long period of time. Moreover, the printed circuit board and the terminal base may not be separated from the main body easily during the insertion or removal of the external Network cable, so that the durability of the keystone jack of the present invention is improved greatly.

DETAILED DESCRIPTION OF THE INVENTION

Figure 1:
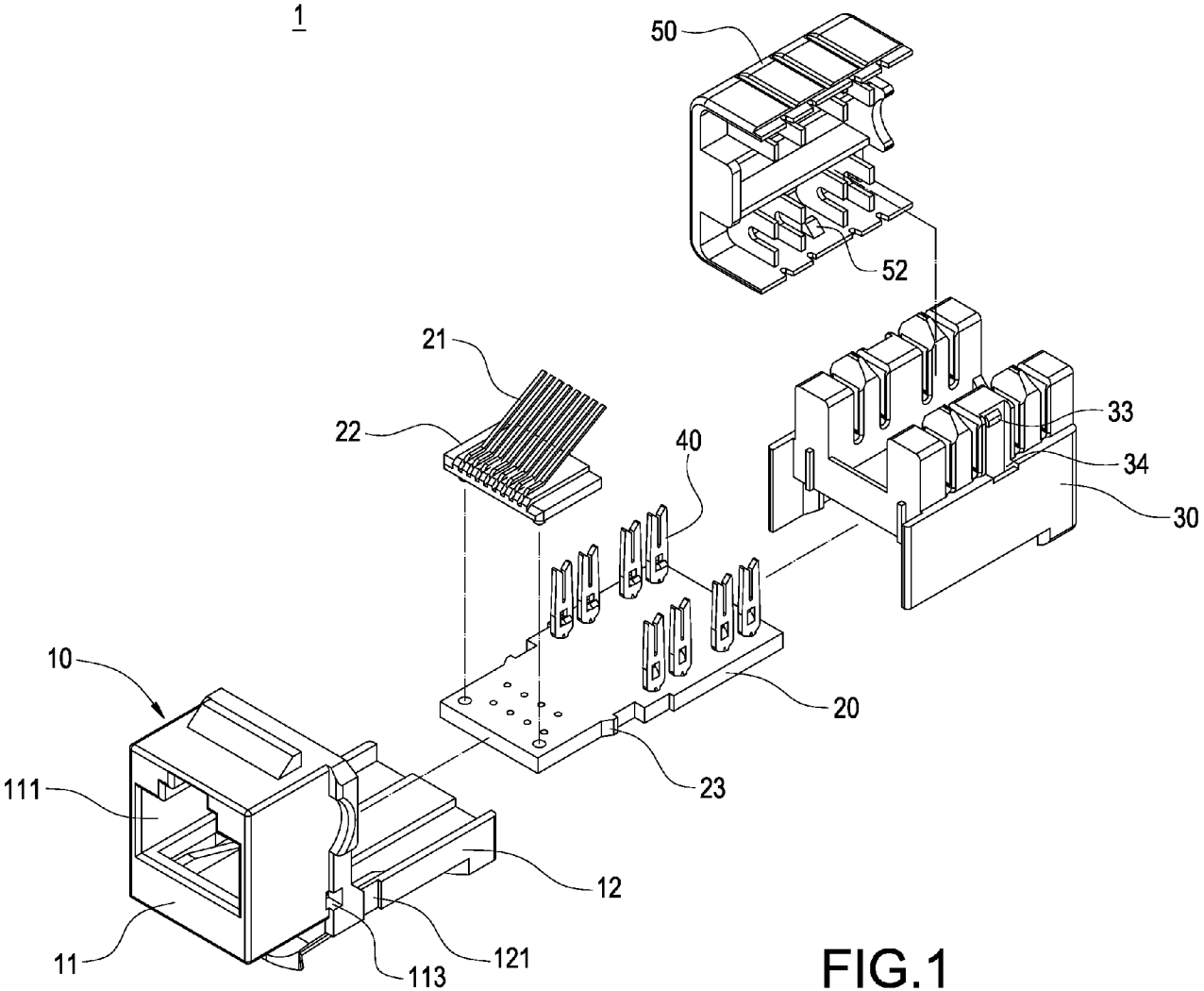
FIG. 1 is an exploded perspective view of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 8. The present invention provides a keystone jack 1, which includes a main body 10, a printed circuit board 20, a terminal base 30, and a plurality of terminals 40.

The main body 10 is made of electrical insulating materials such as plastic materials. The main body 10 is constituted of a body portion 11 and a bottom plate 12 extending from the body portion 11. The body portion 11 is located at a front end of the main body 10. The bottom plate 12 is connected to the bottom surface of the body portion 11. The body portion 11 is provided with an insertion slot 111 for allowing an external Network cable (not shown) to be inserted therein. The bottom plate 12 is configured to support the printed circuit board 20 when the printed circuit board 20 is inserted into the main body 10.

Figure 2:
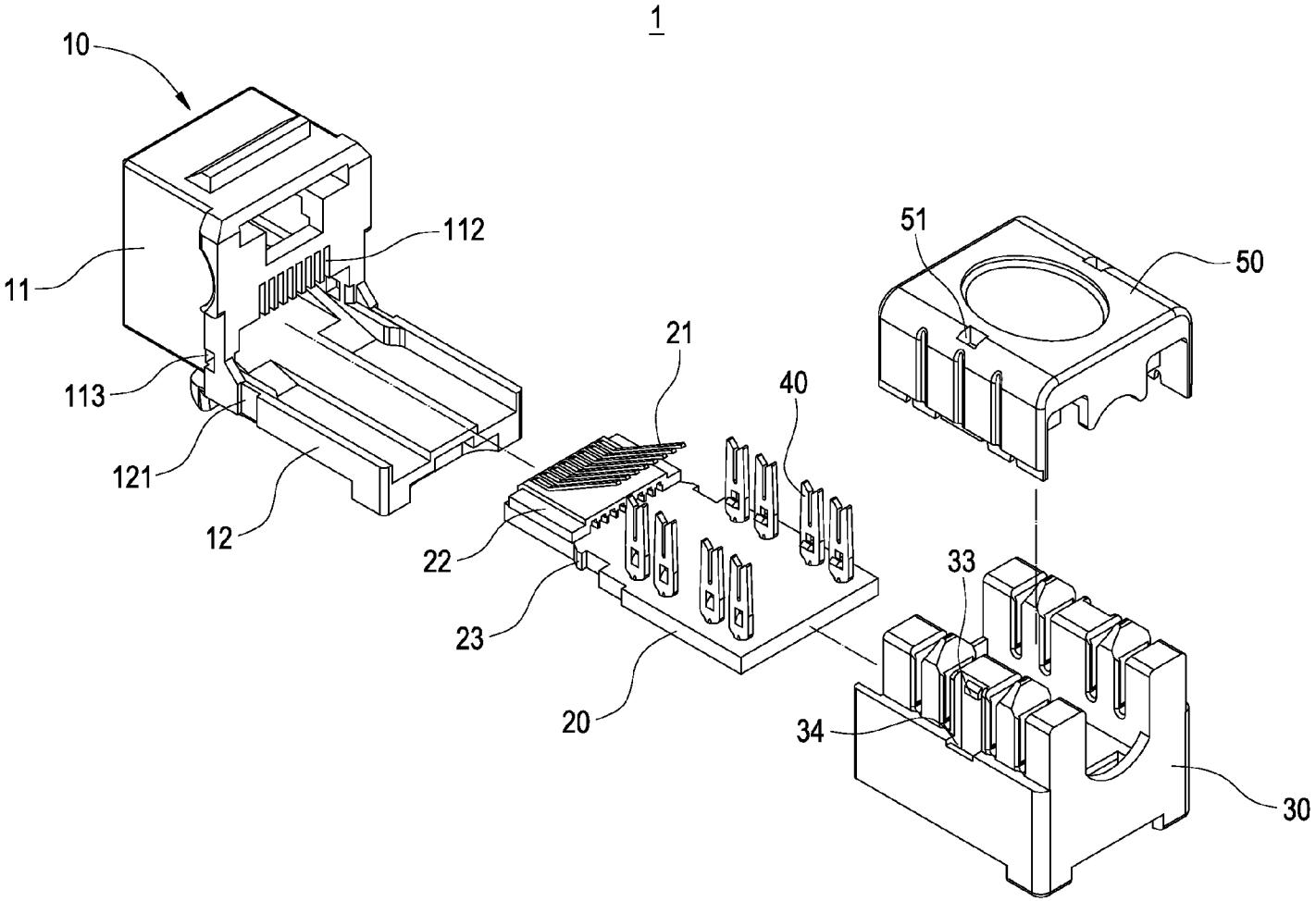
FIG. 2 is an exploded perspective view of the present invention taken from another viewing angle.

As shown in FIG. 2, the main body 10 is provided with a plurality of terminal troughs 112 in communication with the insertion slot 111. When the external Network cable is inserted into the insertion slot 111 of the main body 10, the terminals (not shown) of the Network cable are brought into electrical contact with a plurality of electrical-conductive terminals 21 formed on the front end of the printed circuit board 20 via the terminal troughs 112.

Both sides of the main body 10 are provided with two first troughs 113 and two second troughs 121. More specifically, the first troughs 113 are provided on peripheral walls of the body portion 11 adjacent to the bottom plate 12. The second troughs 121 are provided on both sides of the bottom plate 12. It should be noted that the locations of the first troughs 113 and the second troughs 121 are located on the same two sides of the main body 10, which is in parallel to the inserting direction of the external Network cable into the insertion slot 11 of the main body 10 and also in parallel to the inserting direction of the printed circuit board 20 into the main body 10.

The printed circuit board 20 is inserted into the main body 10. One end of the printed circuit board 20 adjacent to the main body 10 (left end in FIG. 1) is provided with a plurality of electrical-conductive terminals 21 (such as golden fingers). More specifically, the electrical-conductive terminals 21 are fixed to a stand 22. Then, the stand 22 together with the electrical-conductive terminals 21 are soldered on the printed circuit board 20. Both sides of the printed circuit board 20 are formed with two first hooks 23 engaged with the two first troughs 113. The locations of the first hooks 23 correspond to the locations of the first troughs 113 of the main body 10.

An end of the printed circuit board 20 away from the main body 10 (right end in FIG. 1) is provided with a plurality of piercing terminals 40. These piercing terminals 40 are disposed on the printed circuit board 20 to vertically pierce the printed circuit board 20. Both ends of each piercing terminal 40 are inserted into the printed circuit board 20 and the terminal base 30 respectively.

The terminal base 30 is also made of electrical insulating materials such as plastic materials. The terminal base 30 is disposed on the printed circuit board 20 to be assembled with the main body 10. It can be seen from FIG. 3 that, both sides of the terminal base 30 are formed with two second hooks 31 engaged with the two second troughs 121. The bottom surface of the terminal base 30 is provided with a plurality of terminal holes 32 for allowing the piercing terminals 40 to be inserted therein. The second hooks 31 are formed on two facing inner walls of the terminal base 30 and correspond to the two second troughs 121 respectively.

Figure 3:
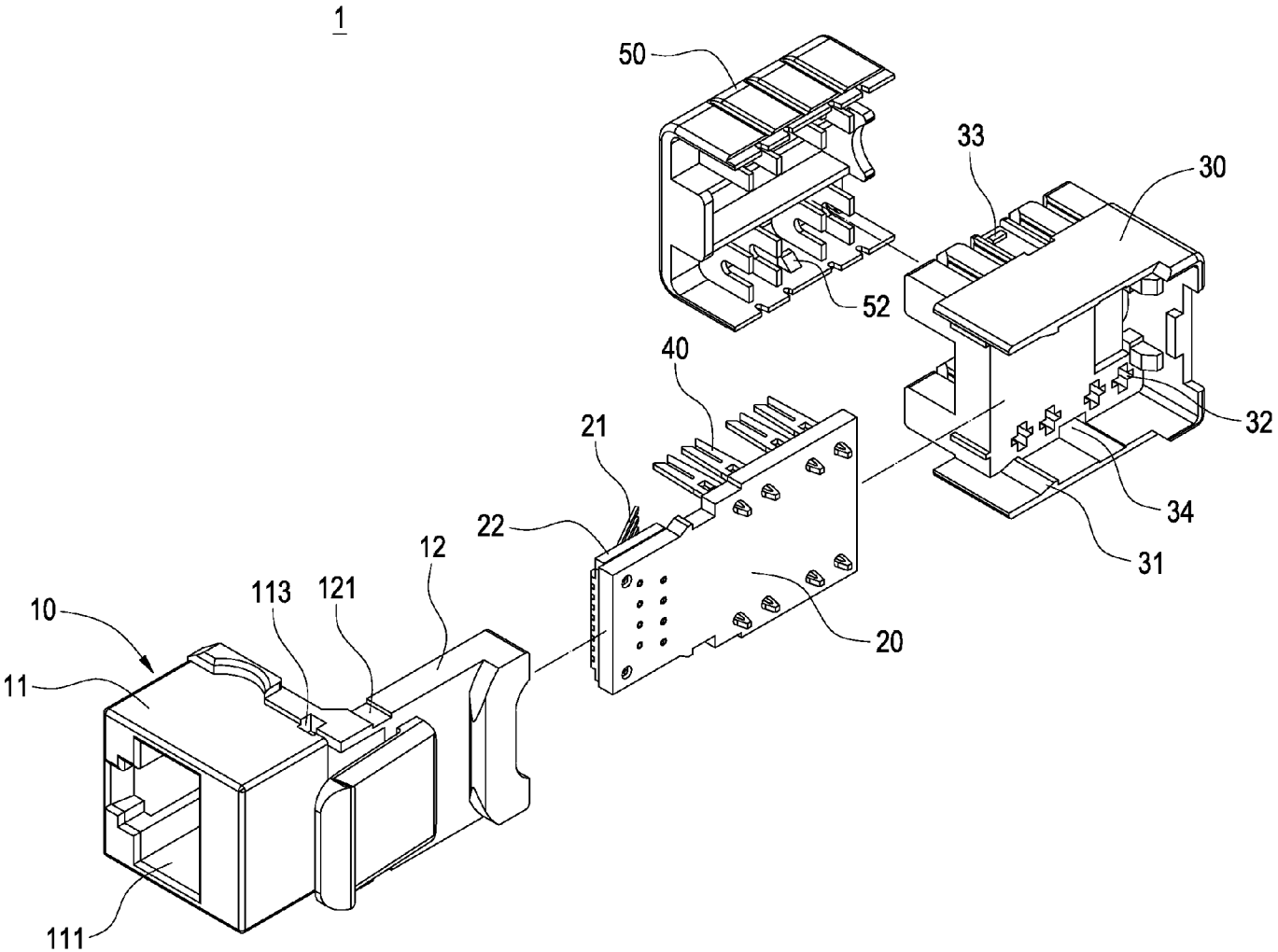
FIG. 3 is an exploded perspective view of the present invention as seen from the bottom.
Figure 8:
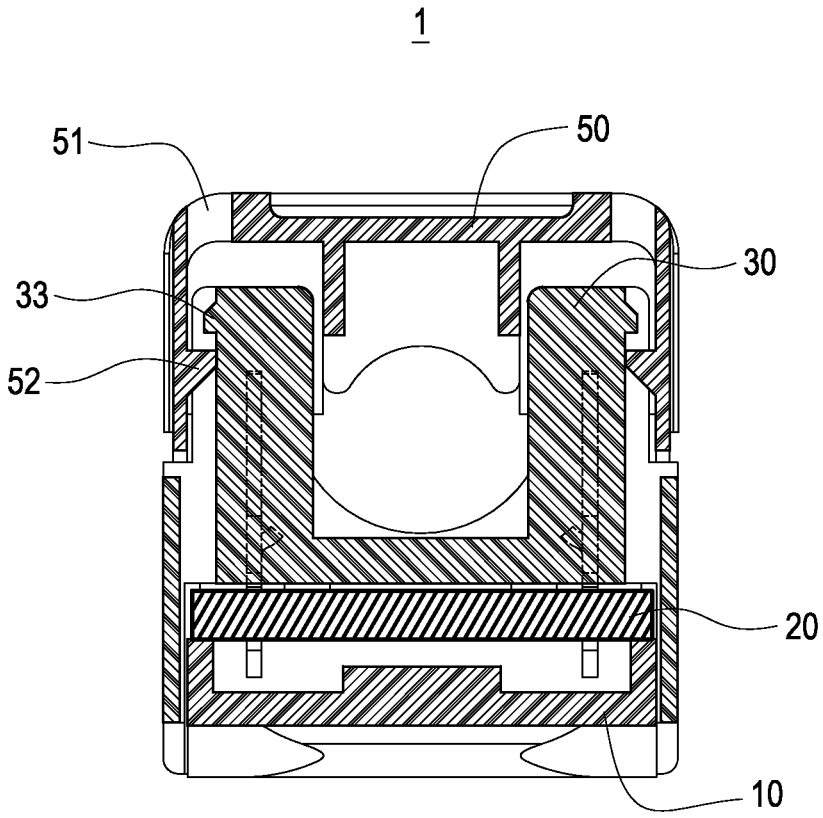
FIG. 8 is a cross-sectional view of the present invention taken along the line of 8-8 in FIG. 4.

The keystone jack 1 of the present invention further comprises a dustproof cover 50. The dustproof cover 50 is assembled with the terminal base 30 for covering the terminal base 30, the terminals 21, 40 and the printed circuit board 20. It can be seen from FIG. 2 that, two top edges of the terminal base 30 are provided with two positioning blocks 33. As shown in FIG. 3, a through trough 34 is formed below each positioning block 33 and near the bottom surface of the terminal base 30. The top surface of the dustproof cover 50 is formed with two positioning holes 51 corresponding to the two positioning blocks 33. The inner walls of the two positioning holes 51 are formed with two engaging hooks 52 as shown in FIGS. 1 and 3. A user first aligns the positioning blocks 33 with the positioning holes 51 and then covers the dustproof cover 50 onto the terminal base 30. Thereafter, as shown in FIG. 8, the engaging hooks 52 of the dustproof cover 50 pass through the through troughs 34 of the terminal base 30 to be engaged with the bottom surface of the terminal base 30. In this way, the dustproof cover 50 can be fixedly engaged with the terminal base 30.

Figure 4:
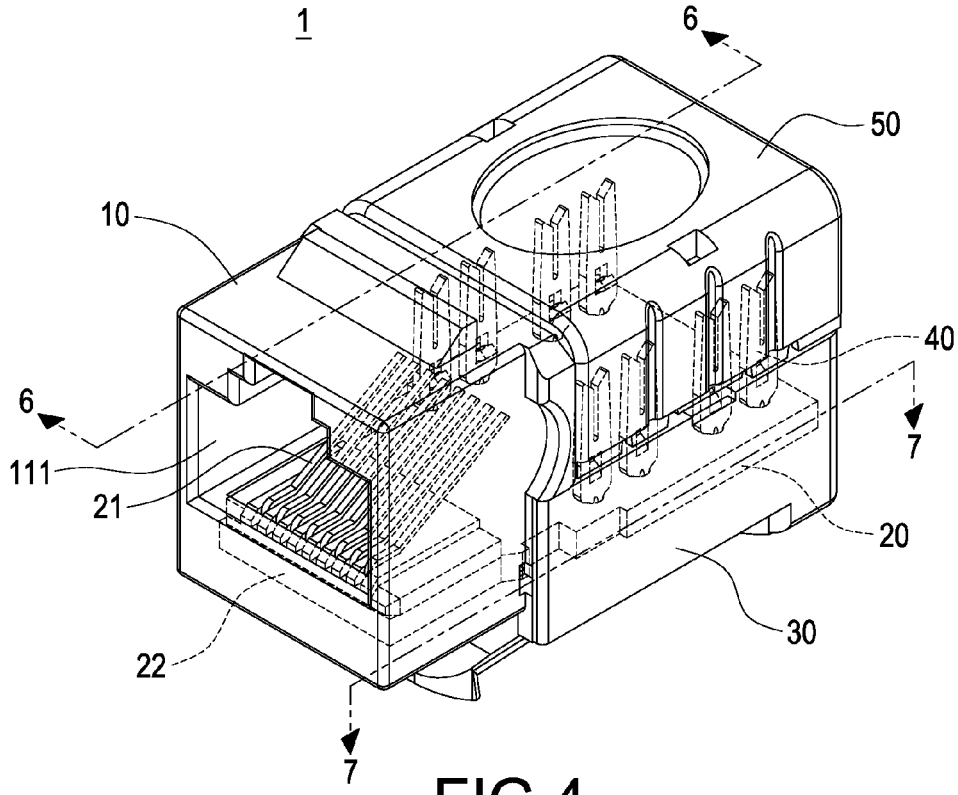
FIG. 4 is an assembled perspective view of the present invention.
Figure 5:
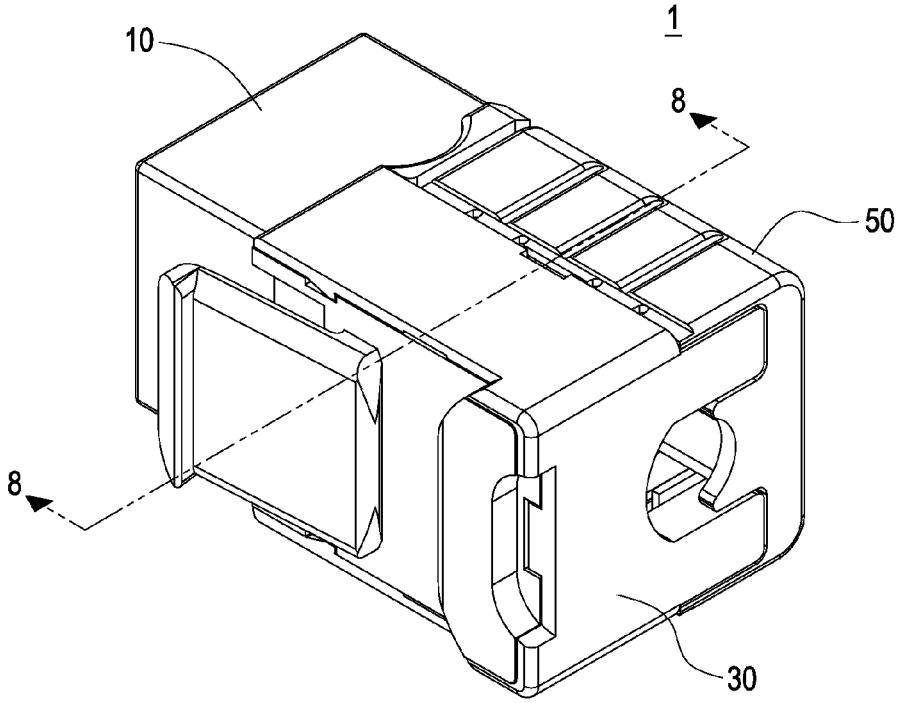
FIG. 5 is an assembled view of the present invention.
Figure 6:
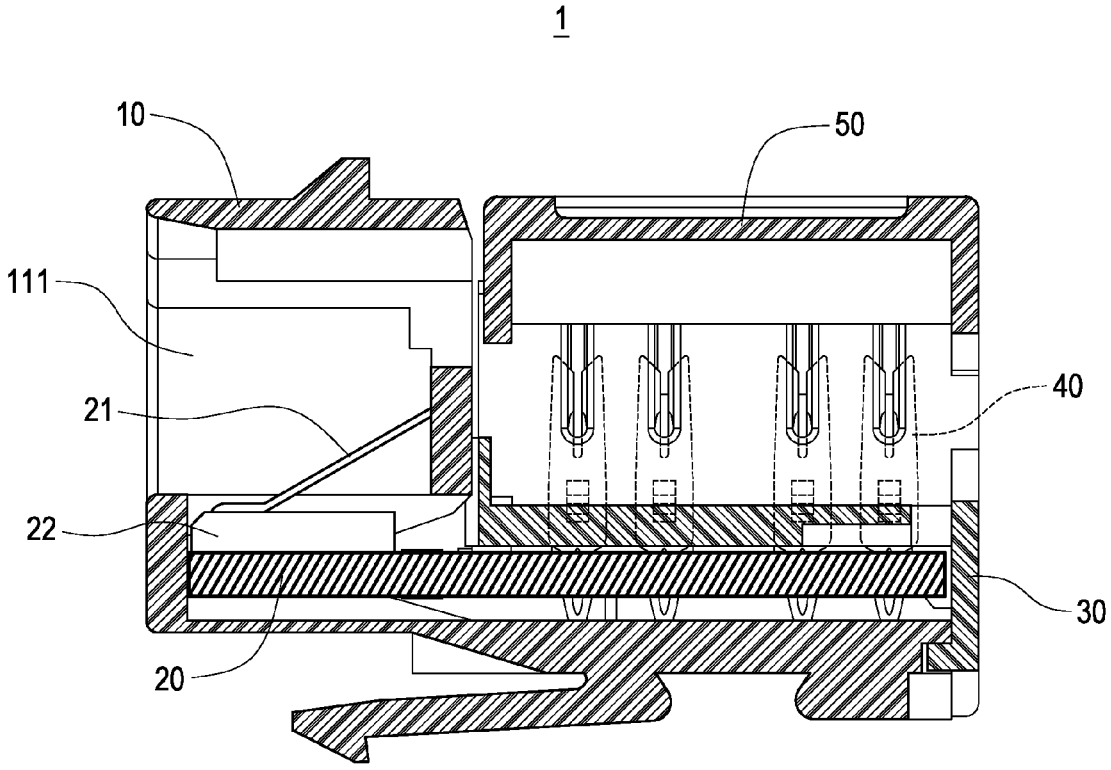
FIG. 6 is a cross-sectional view of the present invention taken along the line of 6-6 in FIG. 4.
Figure 7:
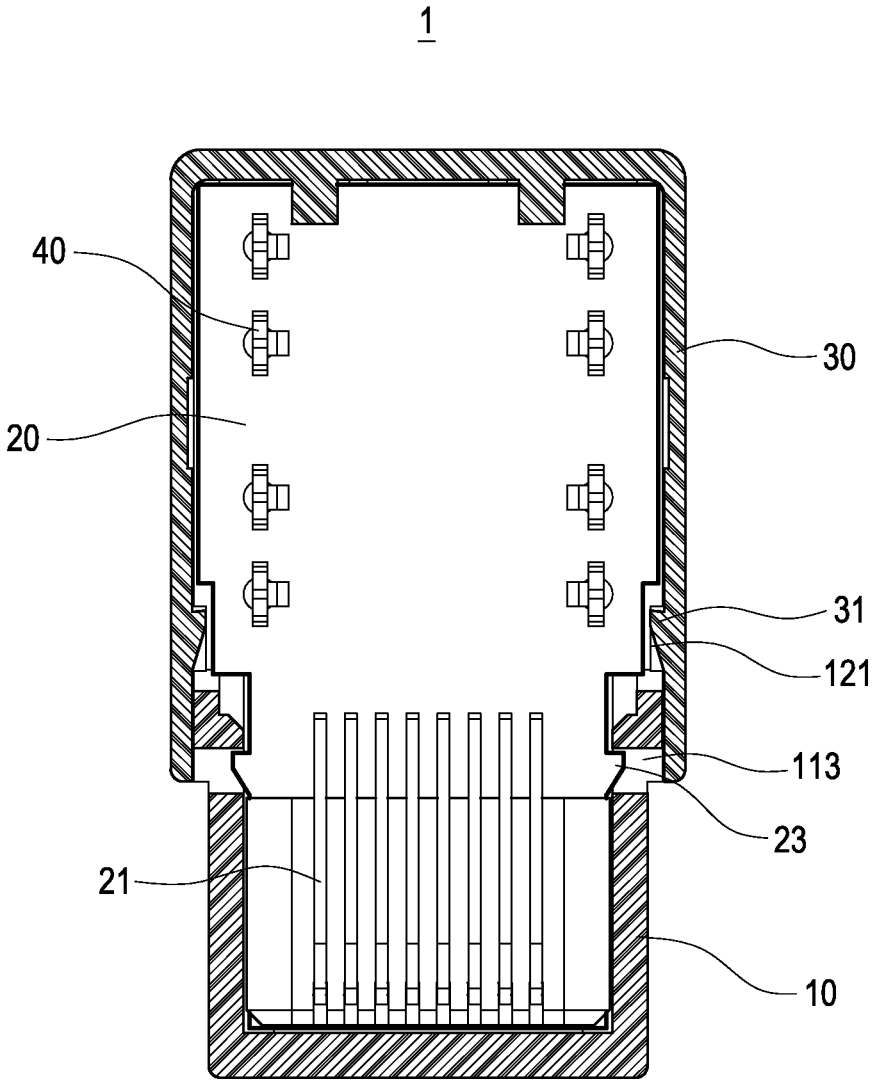
FIG. 7 is a cross-sectional view of the present invention taken along the line of 7-7 in FIG. 4.

In assembling, the electrical-conductive terminals 21 together with the stand 22 are first soldered on the printed circuit board 20. Then, one ends of the piercing terminals 40 pierce the holes (not shown) on the printed circuit board 20. Second, the terminal cover 30 covers the printed circuit board 20 in such a manner that the other ends of the piercing terminals 40 insert into the terminal holes 32 of the terminal base 30. In this way, the terminal base 30 and the printed circuit board 20 are assembled with each other to form an assembly. Third, as shown in FIG. 7, the assembly constituted of the terminal base 30 and the printed circuit board 20 is inserted into the main body 10 while the first hooks 23 of the printed circuit board 20 are engaged with the first troughs 113 of the main body 10 and the second hooks 31 of the terminal base 30 are engaged with the second troughs 121. In this way, the assembly of the printed circuit board 20 and the terminal base 30 is assembled with the main body 10 to form a semi-product. Fourth, the dustproof cover 50 covers the terminal base 30 in a direction perpendicular to the inserting direction of the printed circuit board 20 and the terminal base 30 into the main body 10. In this way, a final product shown in FIGS. 4 and 5 is obtained.

It should be noted that, in the present embodiment, although the first hooks 23 of the printed circuit board 20 are located at a front half section of the printed circuit board 20, and the second hooks 31 of the terminal base 30 are located at a front half section of the terminal base 30. However, the locations of the first hooks 23 are not limited thereto as long as they correspond to the locations of the first troughs 113 of the main body 10. Thus, the first hooks 23 may be provided at a middle section on both sides of the printed circuit board 20. Similarly, if the second troughs 121 are formed at the middle position on both sides of the printed circuit board 20, the second hooks 31 are formed at the middle position on both sides of the terminal base 30 correspondingly.

In comparison with prior art, the present invention has the following advantageous features:

According to the keystone jack of the present invention, both sides of the main body 10 are provided with two first troughs 113 and two second troughs 121, both sides of the printed circuit board 20 are formed with two first hooks 23 engaged with the two first troughs 113, and both sides of the terminal base 30 are formed with two second hooks 31 engaged with the two second troughs 121. Therefore, the present invention has double engaging means. More specifically, the first engaging means (that is, the first troughs 113 and the first hooks 23) is configured to fixedly connect the main body 10 and the printed circuit board 20, and the second engaging means (that is, the second troughs 121 and the second hooks 31) is configured to fixedly connect the main body 10 and the terminal base 30. Finally, the piercing terminals 40 pierce the printed circuit board 20 and the terminal base 30. In this way, the main body 10, the printed circuit board 20, and the terminal base 30 can be firmly engaged with each other. Therefore, the present invention employs double engaging means to generate a greater strength of engagement among the respective components of the keystone jack 1. In this way, the problem of stress concentration is avoided, and the keystone jack 1 can be prevented from breaking or suffering damage.

Further, the engaging means between the main body 10 and the printed circuit board 20 is provided on both sides of the main body 10 and the printed circuit board 20, and the other engaging means between the main body 10 and the terminal base 30 is provided on both sides of the main body 10 and the terminal base 30. Both engaging means (the first troughs 113 and the first hooks 23, the second troughs 121 and the second hooks 31) are provided on the same two sides of the main body 10, which is in parallel to the inserting direction of the printed circuit board 20 into the main board 10. Further, the two engaging means are provided in parallel to the direction in which an external Network cable is inserted into or removed from the keystone jack 1. Therefore, the keystone jack 1 of the present invention has a greater strength for sustaining the insertion and removal of the external Network cable for a long period of time. Moreover, the printed circuit board 20 and the terminal base 30 may not be separated from the main body 10 easily during the insertion and removal of the external Network cable, so that the durability of the keystone jack 1 of the present invention is improved greatly.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A keystone jack, including:

a main body having two first troughs and two second troughs on both sides thereof;

a printed circuit board inserted into the main body, both sides of the printed circuit board being formed with two first hooks engaged with the two first troughs;

a terminal base disposed on the printed circuit board and assembled with the main body, both sides of the terminal base being formed with two second hooks engaged with the two second troughs; and a plurality of terminals, both ends of each terminal being fixedly inserted into the printed circuit board and terminal base respectively, wherein the main body comprises a body portion and a bottom plate extending from the body portion, the body portion is provided with an insertion slot for receiving an external network cable, the bottom plate is configured to support the printed circuit board, the two first troughs are provided on peripheral walls of the body portion and adjacent to the bottom plate, the two second troughs are provided on both sides of the bottom plate respectively, and the second hooks are formed on two facing inner walls of the terminal base to correspond to the two second troughs respectively.

2. The keystone jack according to claim 1, wherein the two first troughs and the two second troughs are located on the same two sides of the main body in parallel to an inserting direction of the external network cable into the insertion slot and an inserting direction of the printed circuit board into the main body.

3. The keystone jack according to claim 2, wherein the two first troughs and the two second troughs are formed at a front half section on both sides of the main body, respectively, the two first hooks are formed at a front half section on both sides of the printed circuit board, respectively, and the two second hooks are formed at a front half section on both sides of the terminal base, respectively.

4. The keystone jack according to claim 2, wherein the two first troughs are formed at a front half section on both sides of the main body, respectively, the two second troughs are formed at a middle section on both sides of the main body, respectively, the two first hooks are formed at a front half section on both sides of the printed circuit board, respectively, and the two second hooks are formed at a middle section on both sides of the terminal base, respectively.

5. The keystone jack according to claim 2, wherein the main body is provided with a plurality of terminal troughs in communication with the insertion trough, an end of the printed circuit board adjacent to the terminal troughs is provided with a plurality of electrical-conductive terminals.

6. The keystone jack according to claim 5, wherein the electrical-conductive terminals are golden fingers.

7. The keystone jack according to claim 5, further including a stand, the electrical-conductive terminals being fixed to the stand, the stand together with the electrical-conductive terminals being soldered on the printed circuit board.

8. The keystone jack according to claim 1, wherein the terminals are piercing terminals provided on one end of the printed circuit board away from the main body.

9. The keystone jack according to claim 8, wherein the bottom surface of the terminal base is provided with a plurality of terminal holes for receiving the piercing terminals.

10. The keystone jack according to claim 1, further including a dustproof cover, the dustproof cover covering the terminal base and being assembled with the terminal base.

11. The keystone jack according to claim 10, wherein two top edges of the terminal base are provided with two positioning blocks, respectively, a through trough is formed below each positioning block, the top surface of the dustproof cover is formed with two positioning holes corresponding to the two positioning blocks, inner walls of the two positioning holes are formed with two engaging hooks, respectively, and the two engaging hooks pass through the two through troughs to be engaged with the bottom surface of the terminal base, so that the dustproof cover can be engaged with the terminal base.

* * * * *